US006978919B2

(12) United States Patent
Bönig et al.

(10) Patent No.: US 6,978,919 B2
(45) **Date of Patent: *Dec. 27, 2005**

(54) HOLDER FOR A DRIVE PISTON OF A SETTING TOOL

(75) Inventors: Stefan Bönig, Wasserburg (DE); Franz Büchel, Ruggell (LI); Markus Frommelt, Schaan (LI); Thomas Sperrfechter, Zizers (CH); Norbert Heeb, Buchs (CH); Jens Neumann, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 10/059,838

(22) Filed: Jan. 29, 2002

(65) Prior Publication Data

US 2002/0130155 A1 Sep. 19, 2002

(30) Foreign Application Priority Data

Feb. 9, 2001 (DE) ..... 101 05 884

(51) Int. Cl.[7] ..... B25C 1/14
(52) U.S. Cl. ..... 227/10
(58) Field of Search ..... 227/10, 130; 173/127, 173/210

(56) References Cited

U.S. PATENT DOCUMENTS

| | | | | |
|---|---|---|---|---|
| 3,338,141 | A * | 8/1967 | Ramsay | 173/127 |
| 3,915,242 | A * | 10/1975 | Bell | 173/206 |
| 4,074,845 | A * | 2/1978 | Combette et al. | 227/10 |
| 4,162,033 | A | 7/1979 | Pomeroy | |
| 4,189,081 | A * | 2/1980 | Combette et al. | 227/10 |
| 4,941,391 | A * | 7/1990 | Ehmig et al. | 227/10 |
| 5,029,744 | A * | 7/1991 | Pai | 227/9 |
| 5,170,922 | A * | 12/1992 | Ehmig et al. | 227/8 |
| 5,950,900 | A | 9/1999 | Frommelt et al. | |
| 6,123,243 | A * | 9/2000 | Pfister et al. | 227/10 |
| 6,502,736 | B2 * | 1/2003 | Dittrich et al. | 227/10 |

FOREIGN PATENT DOCUMENTS

| | | |
|---|---|---|
| DE | 1478837 | 3/1969 |
| DE | 8508926 | 6/1985 |
| DE | 3819813 | 12/1989 |

* cited by examiner

*Primary Examiner*—Scott A. Smith
(74) *Attorney, Agent, or Firm*—Abelman, Frayne & Schwab

(57) ABSTRACT

A piston holder for a drive piston (8) of a setting tool and having a circumferential adjusting surface (16) inclined toward a central axis (17) thereof so that a diameter of the adjusting surface (16) increase toward a rear, with respect to a setting direction (18) of the setting tool, end of the drive piston (8), with the piston holder including contact elements (22; 24; 36; 38; 40; 41, 52; 53; 58–61) engageable with the adjusting surface (16), and a spring (21; 27; 35; 36; 54; 55; 62) for biasing the contact elements into engagement with the adjusting surface (16).

6 Claims, 4 Drawing Sheets

HOLDER FOR A DRIVE PISTON OF A SETTING TOOL

BACKGROUND OF THE INVENTION

1. Field of the Invention

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. The piston guide has radial openings facing the drive piston, and spring-biased braking balls extending through the radial openings and engaging the drive piston. The spring, which applies a biasing force to the braking balls is formed as a ring spring for applying a radially acting, with respect to the piston, biasing force to the braking balls. The ring spring is provided on its inner profile with a bearing surface acting on the braking ball. The bearing surface is inclined to the piston at an acute angle that opens in a direction opposite a setting direction. When the drive piston moves in the setting direction, it entrains the braking balls therewith. The braking balls expand the ring spring, which results in the bearing surface transmitting the radial biasing force to the braking balls. The braking balls are pressed radially against the piston body by the ring spring. Even with a small displacement of the drive piston in a direction opposite the setting direction, the braking effect can be substantially reduced or eliminated, as the braking balls displace in the same direction as the drive piston, unloading the ring spring. After being unloaded, the ring spring does not press any more the braking balls against the piston body. Further, a possibility still remains that the drive piston would be displaced, before ignition or firing of the setting tool, in the setting direction as a result of, e.g., the setting tool being pressed hard against a constructional component. The displacement in the return direction is effected due to cooperation of the ring spring with the braking balls.

An object of the present invention is to provide a piston holder having a simplified design and which would reliably retain the drive piston in its ignition-ready position in the absence of ignition.

SUMMARY OF THE INVENTION

This and other objects of the present invention, which will become apparent hereinafter, are achieved by providing a piston holder for a drive piston of a setting tool and having a circumferential adjusting surface inclined toward a central axis of the drive piston so that a diameter of the adjusting surface increases toward a rear, with respect to a setting direction of the setting tool, end of the drive piston. The piston holder further includes contact element(s) engageable with the adjusting surface, and a spring for biasing the contact element(s) into engagement with the adjusting surface.

Upon application of the biasing force, the pressure force, which is applied to the adjusting surface, is divided into the axial and radial components. The axial component, which acts in a direction opposite to the setting direction, retains the drive piston in its ignition-ready position or displaces it into this position after it has been displaced in the setting direction as a result of the setting tool being pressed too hard against a constructional component, without the ignition process initiated.

The piston holder has a simple structure and includes simple components for applying pressure to the adjusting surface. For as symmetrical as possible distribution of the pressure force, a plurality of contact members can be uniformly arranged along a circumference about the piston body.

The adjusting surface can be formed as a flat wedge surface or as coaxial with the central axis of the drive piston, conical surface. In the latter case, the conical section of the drive piston body widens toward the rear, with respect to the setting direction, end of the drive piston. However, the adjusting surface can also be formed by a section of a circumferential bead provided on the piston, or a section of a circumferential groove formed in the drive piston.

In case the adjusting surface is formed by a section of a circumferential bead, the surface is formed by the front, in the setting direction, section of the bead. However, in case the adjusting surface is formed by a circumferential groove, the adjusting surface is formed by a rear, in the setting direction, section of the groove. Independent from how the adjusting surface is formed, it is important that the respective section of the bead or groove, be further spaced from the central axis of the piston as it extends toward the rear end of the drive piston. The respective sections can be formed as flat surface. However, in case of a bead or groove, they can be convex or concave respectively.

The contact means of the piston holder can be formed of one contact member that can be either formed as a rigid body or as an elastic body. The important thing is that it should be non-rigidly pressed against the adjusting surface and be able to introduce the axial force component into the drive piston.

According to a particular advantageous embodiment of the present invention, the contact member is biased in the direction opposite to the setting direction against a stop. The contact member biasing spring is arranged axially, which permits to compensate even large positioning errors of the drive piston. This spring also insures that the piston always occupies an optimal ignition-ready position when the setting tool is released.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
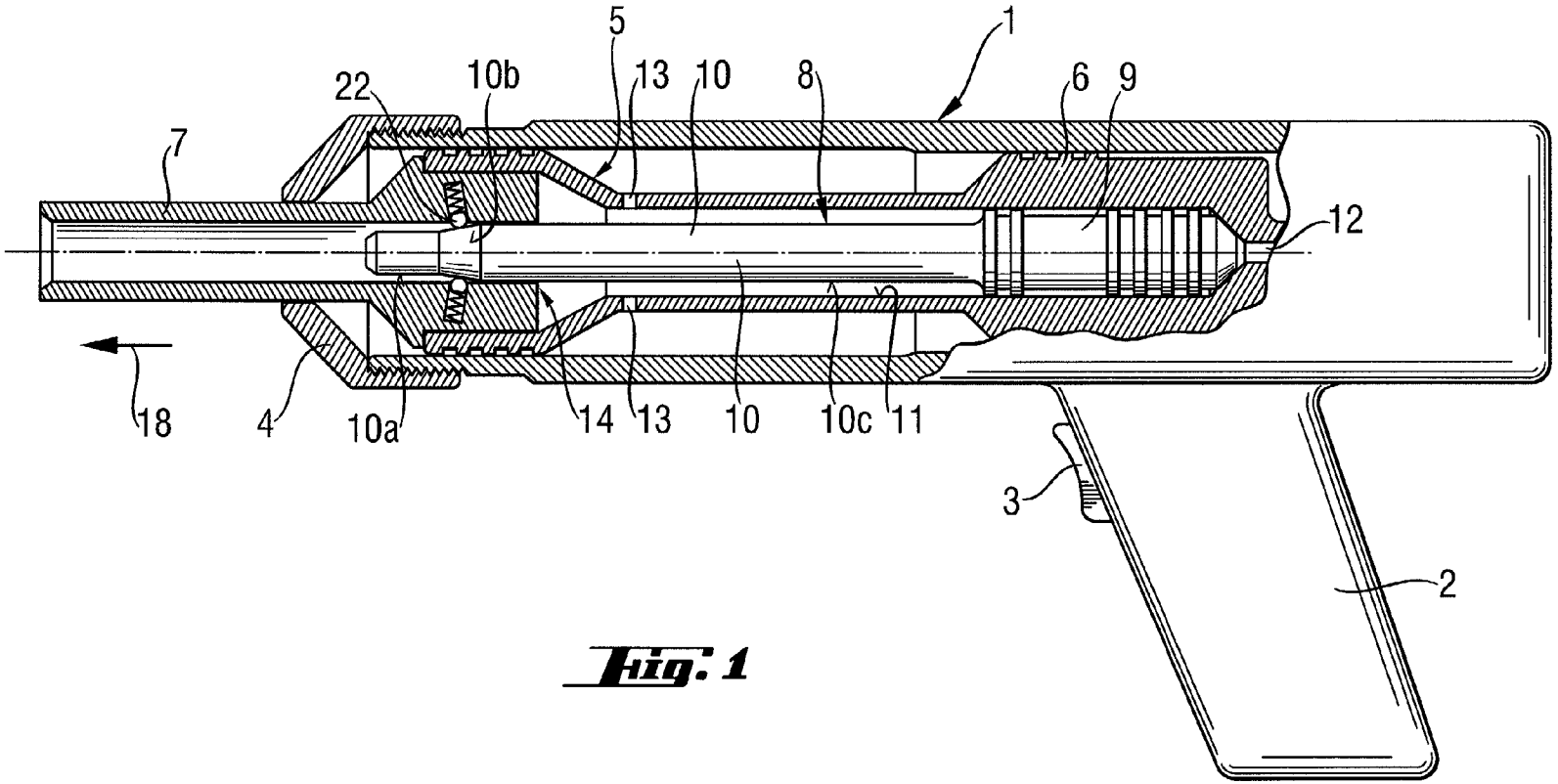
FIG. 1 a partially cross-sectional side view of a setting tool that can be equipped with a piston holder according to the present invention.

A piston holder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston body 10 has a front cylindrical section l0*a* that is adjoined at its rear end by a cone section 10*b* which widens toward the rear end of the drive piston 8, i.e., the diameter of the cone section 10*b* increases toward the rear end of the drive piston 8. Another cylindrical section 10*c* adjoins the conical section 10*b* at its rear end. The diameter of the rear cylindrical section 10*c* can be larger than the diameter of the front section 10*a*.

The piston holder according to the present invention is arranged in a receiving cavity 14 formed in the front portion of the piston guide 5.

Below, different embodiment of a piston holder according to the present invention will be described in detail with reference to respective drawing figures in which the same elements are designated with the same reference numerals.

Figure 2:
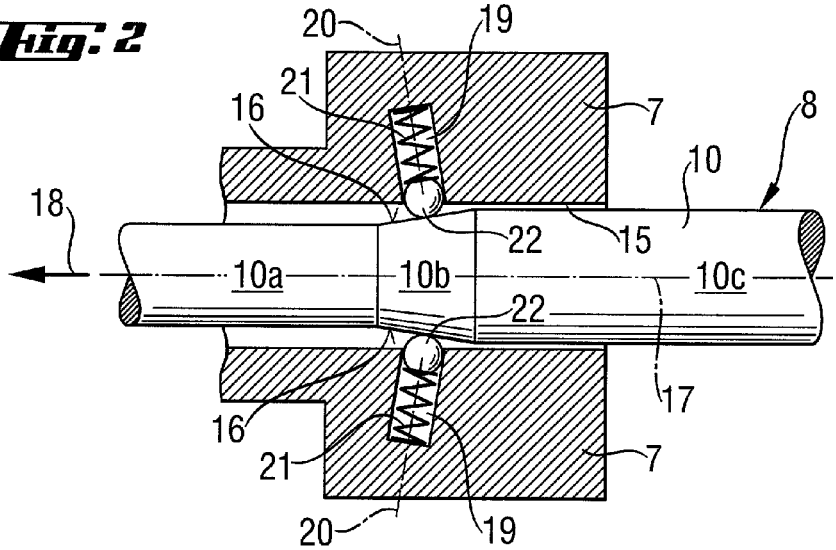
FIG. 2 a partial cross-sectional view showing a first embodiment of a piston holder according to the present invention.

A first embodiment of the inventive piston holder is shown in FIG. 2. The drive piston body 10 is displaceable in a guide bore 15 formed in the front part 7 of the piston guide 5. The cone section 10*b* of the piston body 10 has an adjusting surface 16 coaxial with a central axis 17 of the piston body 10 and of the drive piston 8. The drive piston 8 is displaceable from it ignition-ready position in drive-out direction that is shown with arrow 18.

Two cylindrical cavities 19 are formed in the front part 7 diametrically opposite each other with respect to the piston body 10. The central axis 20 of each cylindrical cavity 19 extends at least approximately perpendicular to the adjusting surface 16. In each of the cavity 19, there is arranged a compression spring 21 and a ball-shaped contact member 22. The contact member 22 is so positioned in the cylindrical cavity 19 that the compression spring 21 biases the respective contact member 22 against circumferential surface 16. With this arrangement of the contact member 22, the contact member 22 and the surface 16 provide for introduction into the piston body 10 of radial and axial components of the biasing force generated by the spring 21. The axial component of the biasing force, which acts in a direction opposite to the drive piston drive-out or setting direction 18, retains the drive piston 8 in its ignition-ready position or displaces the drive piston 8 a short distance into the ignition-ready position in case the setting tool is pressed too hard against a constructional component, without the ignition process being initiated. In case that the cylindrical section 10*c* is located in the region of the ball-shaped contact members 22, during a setting process, the force components introduced into the piston body 10 and acting in a direction opposite the setting direction would be much smaller of those introduced into the piston body 10 in case the conical section 10*b* is located in the region of the contact members 22.

It should be noted that the contact member 22 can be formed by rollers, discs, or rolls with a negative piston shape.

Figure 3:
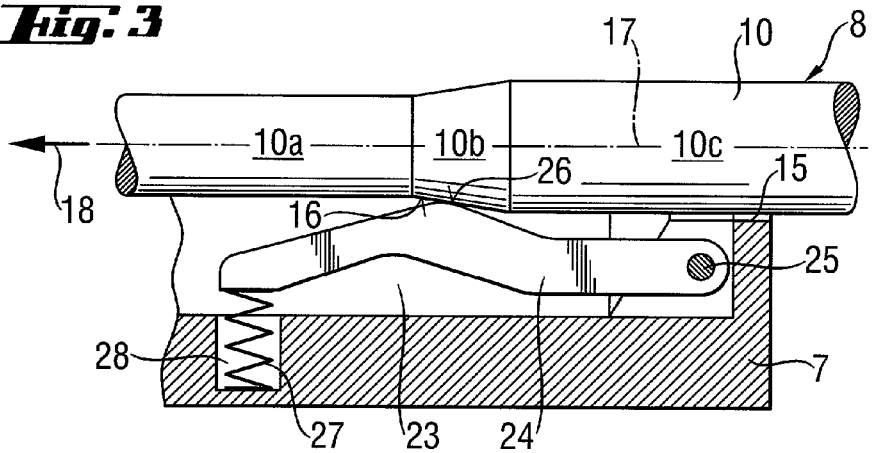
FIG. 3 a partial cross-sectional view showing a second embodiment of a piston holder according to the present invention.

A second embodiment of the inventive piston holder is shown in FIG. 3. The piston holder has a contact lever 24 which is received in an axial cavity 23 formed in the front part 7 of the piston guide 5 and opening in the setting direction 18. The contact lever 24 extends substantially in the axial direction of the piston body 10 and has its rear, with respect to the setting direction 18, end pivotally supported on an axle 25 supported in the front part 7. Toward the front end of the drive piston 8, the contact lever 24 is tangent-bent toward the piston body 10 forming a roof-shaped section a contact edge 26 of which contacts the conical section 10*b* in the ignition-ready position of the drive piston 8. The free end of the contact lever 24 is biased toward the piston body 10 by a compression spring 27 that is located in a cavity 28 formed in the front part 7. The compression spring 27 constantly biases the contact lever 24 toward the piston body 10, retaining the drive piston 8 in its ignition-ready position shown in FIG. 3.

Figure 4:
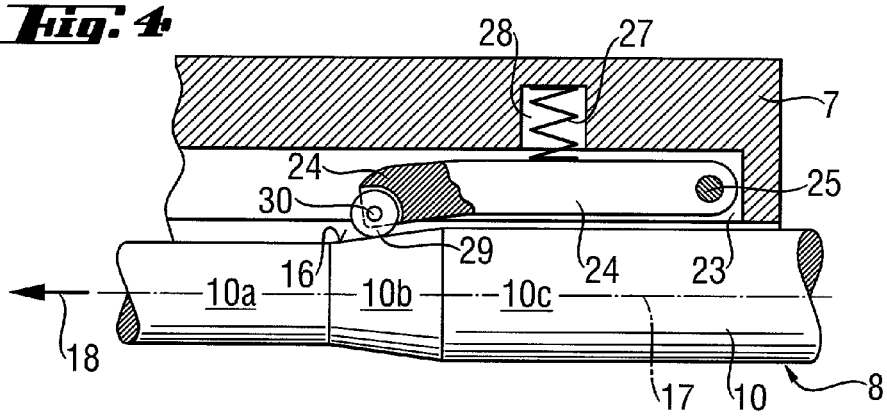
FIG. 4 a partial cross-sectional view showing a third embodiment of a piston holder according to the present invention.

A third embodiment of the inventive piston holder is shown in FIG. 4. In this embodiment, the contact lever 24, which is arranged in the axial cavity 23 and is pivotally supported on the axle 25, is provided, at its front, free end with a roller-shaped contact element 29 rotatable about an axle 30 supported in the contact lever 24. The contact element 29 can be formed, e.g., as an elastic roller or as a roller having an elastic core. The contact element 29 engages the adjusting surface 16 of the conical section 10*b* in the ignition-ready position of the drive piston 8, which is shown in FIG. 4. The contact element 29 is constantly biased into engagement with the piston body 10 by the compression spring 27 located in the cavity 28 formed in the front part 7.

Figure 5:
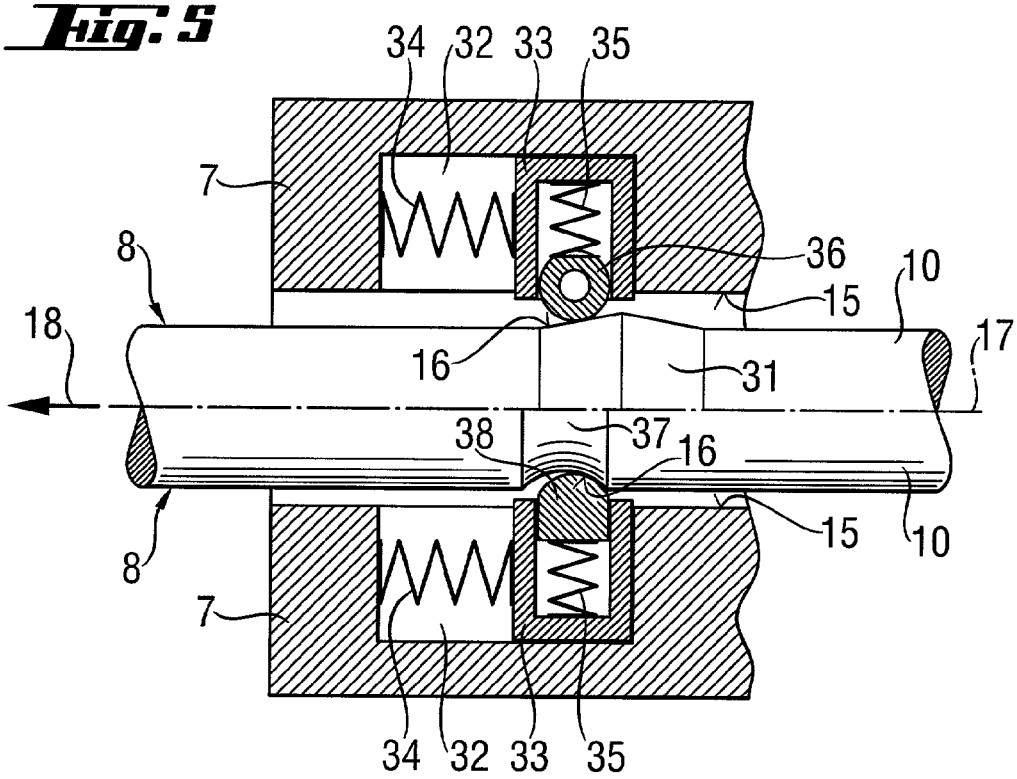
FIG. 5 a partial cross-sectional view showing fourth and fifth embodiments of a piston holder according to the present invention.

FIG. 5 shows fourth and fifth embodiments of a piston holder according to the present invention, with the upper portion of FIG. 5 showing the fourth embodiment, and the lower portion of FIG. 5 showing the fifth embodiment.

According to the fourth embodiment, the drive piston 8 is modified by being provided in the region of the piston body 10 with a circumferential roof-shaped bead 31 having the adjusting surface 16. The diameter of the adjusting surface 16 increases toward the rear end of the drive piston 8. Inside a cavity 32, which is formed in the front part 7 and opens toward the piston body 10, there is provided a cage 33 which likewise radially opens toward the piston body 10 and is axially displaceable. A compression spring 34, which is located in the cavity 32, biases the cage 33 in a direction toward the rear, with respect to the setting direction 18, end of the cavity 32. A radial compression spring 35 is arranged in the cage 33 and biases a roll-shaped contact member 36 toward the piston body 10. In the ignition-ready position of the drive piston 8, the contact member 36 is biased against a first section of the adjusting surface 16 to reliably hold the drive piston 8 in its ignition-ready position. The axially acting compression spring 34 permits to substantially eliminate large errors in positioning of the drive piston 8 in its ignition-ready position. By biasing the cage 33 toward its position corresponding to the ignition-ready position of the drive piston 8, the compression spring 34 insures that the drive piston 8 is reliably held in this position.

During a forward movement of the drive piston 8, upon ignition, the contact member 36 is biased against the body of the drive piston 8. Upon return movement of the drive piston 8, as the adjusting surface 16 approached the contact member 36, the contact member 36 becomes biased against the second section, applying a braking force to the drive piston due to the ascending nature of the second section as it passes the contact member. Thereby, bouncing of the drive piston because of a high return speed is prevented.

The roll-shaped contact member 36 can be formed as a rigid or elastic roller, or be formed as a slidable contact member.

According to the fifth embodiment, the drive piston body 10 is provided with a circumferential groove 37 having a concave bottom surface. A rear section of the concave bottom section defines the adjusting surface 16 which cooperates with a piston-shaped contact member 38 that is biased against the adjusting surface 16 by the radially extending compression spring 35. The cooperation of the contact member 38 with the adjusting surface 16 insures that the drive piston 8 is reliably held in its ignition-ready position which is shown in the lower portion of FIG. 5. In case the drive piston 8 is displaced a short distance in the setting direction 18 as a result, e.g., the setting tool being pressed too hard against a constructional component, without the firing of the setting tool, the contact member 38 would insure the return of the drive piston 8 in its ignition-ready position.

Figure 6:
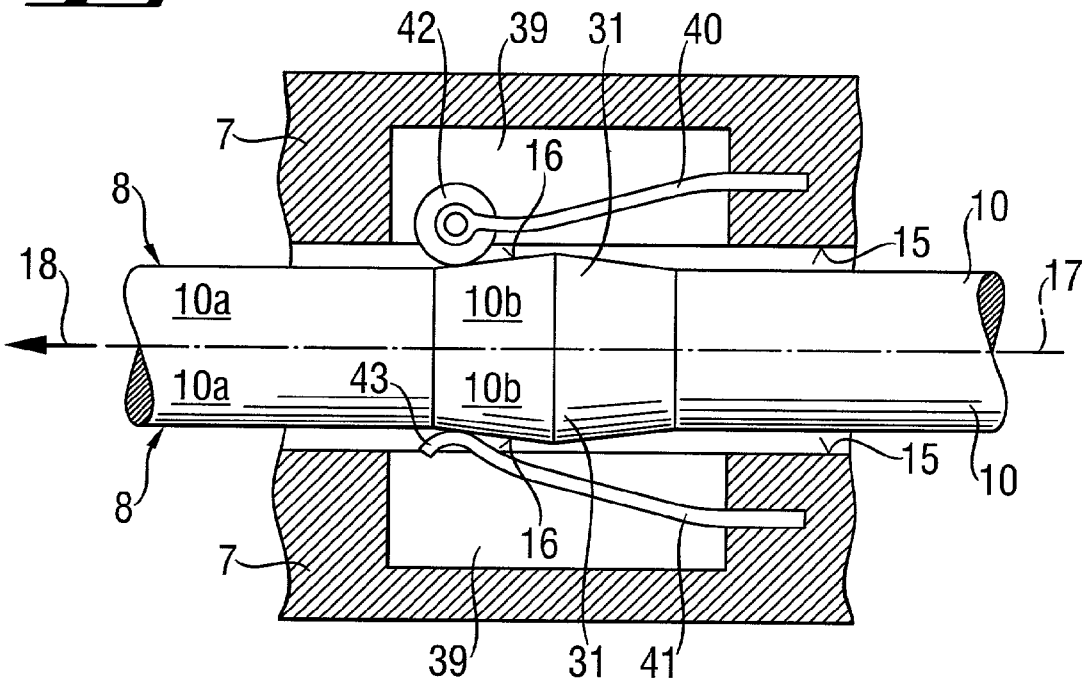
FIG. 6 a partial cross-sectional view showing sixth and seventh embodiments of a piston bolder according to the present invention.

FIG. 6 shows sixth and seventh embodiments of a piston holder according to the present invention, with the upper portion of FIG. 6 showing the sixth embodiment, and the lower portion of FIG. 6 showing the seventh embodiment.

According to the sixth and seventh embodiments, the piston body 10 is provided, as in the fourth embodiment, with a roof-shaped circumferential bead 31, a front, in the setting direction 18, portion of which defines the conical section 10*b* of the piston body 10 with the adjusting surface 16.

A radially open cavity 39, which faces the guide bore 15, is formed in the front part 7 in which a spring arm 40 (41 in the seventh embodiment) is located. The spring arm 40 (41) has its rear end secured in the wall of the cavity 39 facing in the setting direction 18. At the free end of the spring arm 40, there is provided a contact roller 42 (in the seventh embodiment, instead of a contact roller 42, the free end of the spring arm 41 is tangent-bent and forms a bow 43).

In the ignition-ready position of the drive piston 8, due to the elastic characteristics of the spring arm, 40 (41), the roller 42 (bow 43) is pressed against the adjusting surface 16, whereby it is insured that the drive piston 8 is reliably retained in this ignition-ready position.

It should be pointed out that in the fourth, sixth, and seventh embodiments, the contact members 36, 42, 43 can be so positioned that they contact the piston body 10 only in the region of the adjusting surface 16, and have no contact with the piston body 10 in the transitional regions between the conical and cylindrical sections.

Figure 7:
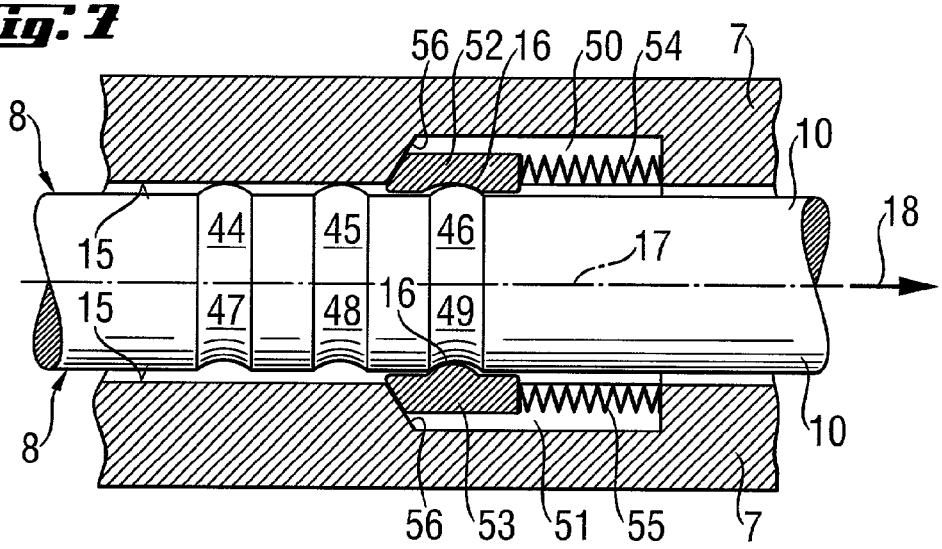
FIG. 7 a partial cross-sectional view showing eighth and ninth embodiments of a piston holder according to the present invention.

FIG. 7 shows eighth and ninth embodiments of a piston holder according to the present invention, with the upper portion of FIG. 7 showing the eighth embodiment, and the lower portion of FIG. 7 showing the ninth embodiment.

In FIG. 7, the arrow 18, which indicates the piston drive-out or setting direction, in distinction from previous embodiments, points rightwardly.

According to the eighth and ninth embodiments, the piston body 10 had a plurality of spaced from each other, in the axial direction of the piston body 10, circumferential convex beads 44, 45, 46 or concave grooves 47, 48, 49, respectively. The convex surfaces of the beads 44, 45, 40 and the concave surfaces of grooves 47, 48, 49 define respective adjusting surfaces 16 located closer to the rear end of the drive piston 8. Instead of respective convex and concave surfaces, the beads 44, 45, 46 and the grooves 47, 48, 49 can be provided with appropriate conical surfaces.

In the front part 7, there is provided a respective cavity 50, 51 radially opening toward the guide channel 15 and extending in the axial direction of the drive shaft 8. Inside the respective cavity 50, 51, there is arranged a respective resilient contact member 52, 53 which is biased in the direction opposite the setting direction 18, by a respective compression spring 54, 55. The contact member 52, 53 is located inside the respective cavity 50, 51 and engages a wall of the cavity 50, 51 facing in the setting direction 18. The contact member 52, 53 is provided, respectively, with a groove for receiving one of the circumferential beads 44, 45, 46 or with a bead for engaging in a respective groove 47, 48, 49. The form—and friction locking spring-biased engagement of the contact members 52, 53 with the respective beads 44, 45, 46 or in the respective groove 47, 48, 49 insures that the drive piston 8 is reliably retained in its ignition-ready position. By providing several beads or grooves, it is insured a more reliable holding of the drive piston 8 in its ignition-ready position with more or less precision. The axially acting compression spring 54, 55 are able to compensate a positioning error during positioning of the drive piston 8 in its ignition-ready position. Thereby, it is insured that the drive piston 8 is always positioned in an optional ignition-ready position. The positioning force can be increased by providing a wedge arrangement 56 of the respective surfaces of the wall of the cavity 50, 51 and the contact member 52, 53, without increasing the stiffness of the resilient contact members 52, 53. The provision of the wedge arrangement 56 permits to further optimize positioning of the drive piston 8 in its ignition-ready position.

Figure 8:
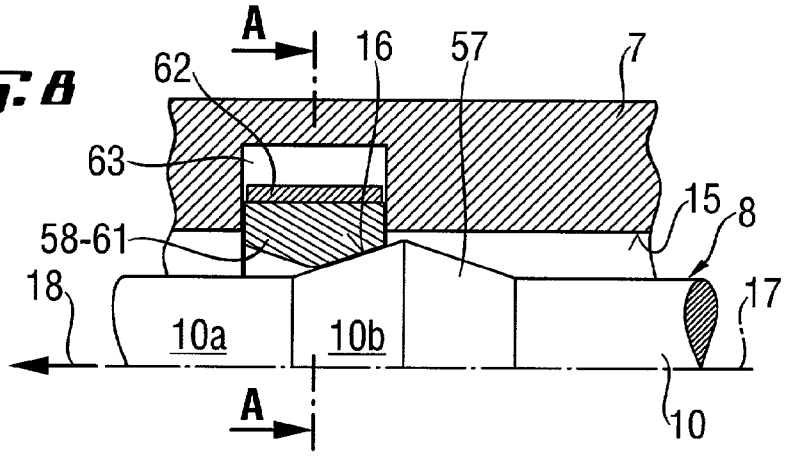
FIG. 8 a partial cross-sectional view showing a tenth embodiment of a piston holder according to the present invention.
Figure 9:
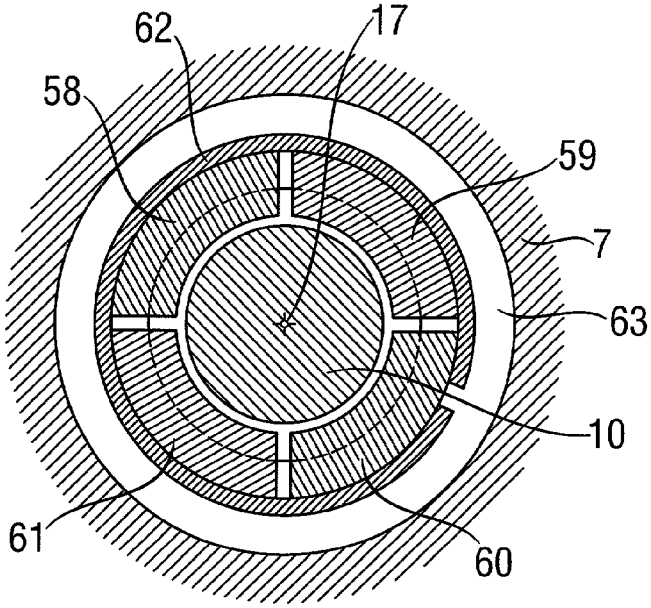
FIG. 9 a cross-sectional view along line A—A in FIG. 8.

FIGS. 8–9 show a tenth embodiment of the piston holder according to the present invention.

As in some of the previous embodiments, the piston body 10 of the drive piston 8 is provided with a roof-shaped circumferential bead 57 that defines the conical section 10*b* of the piston body 10 which adjoins the front section 10*a*. As it has already been discussed above, the conical circumferential surface of the conical section 10*b* forms the adjusting surface 16. The piston holder includes a plurality of contact segments 58, 59, 60, 61 arranged circumferentially about the piston body 10 and impinging the same. The contact segments 58, 59, 60, 61 are spaced from each other by substantially the same angular distance. The contact segments 58, 59, 60, 61 are biased against the adjusting surface 16 by a common ring spring 62 arranged coaxially with the piston body 10. The contact segments 58, 59, 60, 61 and the ring spring 62 are located in the front part 7 of the piston guide 5, in a cavity 63 radially opening toward the guide bore or channel 15.

When the contact segments 58–61 are pressed against the adjusting surface 16 by the ring spring 62, they retain the drive piston 8 in its ignition-ready position, and the cooperation of the contact segments 58–61 with the adjusting surface 16 under the biasing force of the ring spring 62 insures that the drive piston 8 is returned into its ignition-ready position when displaced therefrom as a result of the setting tool being pressed too hard against a constructional component. In the region where the drive piston 8 should be displaced without friction, the drive piston 8 has a smaller diameter (the transition region between the conical and cylindrical surfaces of the piston body 10. In this regions, there is no contact between the contact segments 58–61 and the drive piston 8 or its body 10. The inclination of the conical section 10*b*, i.e., of the adjusting surface 16 should be so selected that no self-clamping takes place. By varying the length of the conical section 10*b* and the contact length of the contact segments 58–61, the positioning error of the drive-piston positioning in the ignition-ready position can be compensated.

Though the present invention was shown and described with references to the preferred embodiments, such are merely illustrative of the present invention and are not to be construed as a limitation there, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A drive piston assembly for a setting tool, comprising a drive piston (8) having a circumferential adjusting surface (16) having a first section inclined toward a central axis (17) of the drive piston (8) so that a diameter of the first section increases toward the rear, with respect to a setting direction (18) of the setting tool, end of the drive piston (8), and a second section adjoining the first section and inclined toward the central axis (17) of the drive piston (8) so that a diameter of the second section diminishes toward rear, with respect to a setting direction (18) of the setting tool, end of the drive piston (8); a piston holder for holding the drive piston (8) in an ignition-ready position thereof and for decelerating the drive piston (8) during return of the drive piston (8) to the ignition-read position after completion of a drive-in process, the piston holder (8) having contact means (22; 24; 36; 40; 41; 52; 53; 58–61) engageable with the adjusting surface (16); first spring means (21; 27; 35; 36; 54; 55; 62) for biasing the contact means into engagement with the first section of the adjusting surface (16) in the ignition-ready position of the drive piston (8) and for biasing the contact means into engagement with the second section for decelerating the drive piston (8) during return of the drive piston (8) to the ignition-ready position; and second spring means (34) for axially biasing the contact means in a direction opposite the setting direction (9) against a stop surface.

2. A drive piston assembly according to claim 1, wherein the adjusting section (16) is formed by a roof-shaped bead (31; 44; 45; 46; 57) defining the first and second sections.

3. A drive piston assembly according to claim 1, wherein each of the first and second sections is formed as a conical surface.

4. A drive piston assembly according to claim 1, wherein contact means comprises at least one contact member.

5. A drive piston assembly according to claim 4, wherein the contact member is formed as a rigid body.

6. A drive piston assembly according to claim 4, wherein the contact member is formed as an elastic body.

* * * * *